United States Patent [19]

Ochiai et al.

[11] 4,124,395

[45] Nov. 7, 1978

[54] SUBBING LAYER ON POLYESTER FILM FOR LIGHT-SENSITIVE MATERIAL

[75] Inventors: Takeji Ochiai; Sho Nakao, both of Fujimiya, Japan

[73] Assignee: Fuji Photo Film Co., Ltd., Minami Ashigara, Japan

[21] Appl. No.: 711,197

[22] Filed: Aug. 3, 1976

Related U.S. Application Data

[63] Continuation-in-part of Ser. No. 496,686, Aug. 12, 1974, abandoned.

[30] Foreign Application Priority Data

Aug. 10, 1973 [JP] Japan ..... 48-89870

[51] Int. Cl.[2] ..... G03C 1/94

[52] U.S. Cl. ..... 96/87 R; 427/207 D; 427/223; 428/483

[58] Field of Search ..... 96/87 R; 427/207, 223

[56] References Cited

U.S. PATENT DOCUMENTS

| | | | |
|---|---|---|---|
| 2,964,401 | 12/1960 | Plambeck | 96/115 P |
| 3,241,973 | 3/1966 | Thommes | 96/115 P |
| 3,353,958 | 11/1967 | Moede | 96/87 R |
| 3,370,951 | 2/1968 | Hasenauer et al. | 96/87 R |
| 3,460,944 | 8/1969 | Cohen | 96/87 R |
| 3,460,945 | 8/1969 | Kolesinski et al. | 96/87 R |
| 3,492,122 | 1/1970 | Takenaka et al. | 96/87 R |
| 3,615,557 | 10/1971 | D'Cruz | 96/87 R |
| 3,630,741 | 12/1971 | Vial | 96/87 R |

*Primary Examiner*—Jack P. Brammer

*Attorney, Agent, or Firm*—Sughrue, Rothwell, Mion, Zinn and Macpeak

[57] ABSTRACT

A light-sensitive material comprising a polyester film, the surface of the polyester film being subjected to a treatment to render the surface hydrophilic, a subbing layer on the treated surface comprising a polymer having carboxyl groups or groups which form carboxyl groups upon hydrolysis and an addition polymerizable monomer selected from the group consisting of acrylic acid, itaconic acid, hexahydro-1,3,5-triacryl-s-triazine, N,N'-bisacryloyl piperazine, diacetone acrylamide and hexamethylene bis-ethyleneureide and a silver halide emulsion layer on the subbing layer, whereby good adhesion between the polyester film and the coating layer is obtained.

14 Claims, No Drawings

SUBBING LAYER ON POLYESTER FILM FOR LIGHT-SENSITIVE MATERIAL

CROSS-REFERENCE TO RELATED APPLICATIONS

This is a continuation-in-part application of copending application Ser. No. 496,686, filed Aug. 12, 1974, now abandoned.

BACKGROUND OF THE INVENTION

1. Field of the Invention

The present invention relates to a light sensitive material. Particularly, it relates to a light sensitive material containing a subbing layer on a polyester film for photographic use.

2. Description of the Prior Art

Hitherto, many kinds of methods of forming a subbing layer have been attempted. However, it has been difficult to obtain good adhesive strength for hydrophilic photographic emulsions because polyester type high molecular materials, as is known, are generally very hydrophobic since they have a high crystallinity and they are linear high molecular weight materials which do not have active functional groups. As prior methods for giving a hydrophilic property to the polyester type high molecular weight materials, a method which comprises applying directly a photographic emulsion to a film after carrying out a surface treatment such as a chemical treatment, a glow discharge treatment, a flame treatment, an active plasma treatment or a laser treatment (e.g., as disclosed in U.S. Pat. Nos. 2,764,520, 3,497,407, 3,145,242, 3,376,208, 3,072,483, 3,475,193 and 3,360,448, and British Pat. No. 788,365) and a method which comprises applying a subbing layer to the polyester film after the above described surface treatment is carried out are known.

Many devices are known for application of the emulsion. Namely, there are a multi-layer coating method which comprises applying a hydrophilic resin layer as a first layer which adheres well to polyester and has good solubility and applying a hydropholic resin layer as a second layer and a mono-layer coating method which comprises applying a resin layer which contains hydrophobic groups and hydrophilic groups in the same polymer. Since the method of forming a subbing layer is preferred, many studies have been done in this area. For example, attempts of using many kinds of resins such as a copolymer of vinylidene chloride or acrylic acid have been made up to now. However, they have the disadvantages that the method of adhesion is complicated or the adhesive strength is not sufficient. In order to compensate for these disadvantages, an expensive solvent, a so-called etching agent, having a high polarity and a high boiling point which swells or dissolves the polyester should be incorporated in a large amount into the primer solution for the subbing layer.

As etching agents, compounds having an aromatic ring (a benzene ring, a naphthalene ring, a pyridine ring, a pyrrole ring or a condensed ring thereof, and those substituted with one or more of alkyl, alkoxy, acyl, nitro, cyano, halogen, hydroxy, formyl, carboxy, carbomethoxy, hydroxyalkyl, carbamoyl, hydroxyalkoxy and aminoalkyl, etc., substituents), compounds having an aromatic ring which is partially hydrogenated, alcohols, ketones, carboxylic acids, esters and aldehydes (e.g., as disclosed in British Pat. Nos. 772,600, 776,157, 785,789, and 797,425, U.S. Pat. Nos. 2,830,030 and German Pat. Nos. 1,020,457 and 1,092,652, etc.), are known.

Examples of such solvents include benzoic acid, salicylic acid, salicylic acid esters, monochloroacetic acid, dichloro-acetic acid, trichloroacetic acid, trifluoroacetic acid, 2-nitropropanol, benzyl alcohol, benzaldehyde, acetonylacetone, acetylphenol, benzamide, benzonitrile, benzyl alcohol, nitrobenzyl alcohol, chlorobenzyl alcohol, pyrrole, chloral hydrate, benzylamine and methyl nicotinate. Furthermore, phenol, o-chlorophenol, p-chlorophenol, cresol, resorcinol and other phenol derivatives are used, which are known as well known solvents or swelling agents for polyesters.

However, since these etching agents and particularly phenolic derivatives generally have a boiling point as high as above 180° C., a rather long period for heating on drying the subbing layer is required. Consequently, a swelling of the support and a reduction in the elasticity thereof occur during the drying step and at particularly the beginning thereof because of the increase in crystallinity due to the permeation of the solvent. Further, since a contracting of the support occurs at a latter period in the drying, the smoothness of the film is remarkably degraded. Moreover, since phenols have a high permeability to the skin, they are difficult to handle. Furthermore, it is necessary to completely recover these materials (etching agents) because they pollute the environment when they are present in waste gases or waste work solutions. Consequently, it is necessary to invest a large amount of money in treating equipment. However, according to the method of using these etching agents, sufficient adhesion between the polyester film and the photographic emulsion can be easily obtained.

Namely, these methods have the disadvantages that it is impossible to carry out a high speed treatment because a long period of treatment is required for the effects of these reagents to be exhibited in addition to the above described disadvantages on handling and operation.

This invention results from research to provide subbing compositions for a polyester film whereby a high speed treatment of about 100 m/min. can be carried out at production without causing any pollution and a good adhesive strength is obtained.

SUMMARY OF THE INVENTION

This invention provides a light-sensitive material comprising a polyester support, a surface of which has been subjected to a treatment to render the surface hydrophilic; a subbing layer on the treated surface comprising a polymer having carboxyl groups or groups which form carboxyl groups upon hydrolysis and an addition polymerizable monomer, the addition polymerizable monomer being present in an amount of about 0.1 to 100% by weight based on the polymer having carboxyl groups or groups which form carboxyl groups upon hydrolysis; and a silver halide emulsion layer on the subbing layer. The present invention is achieved by applying a primer to a polyester support, where the support has been subjected to surface treatment, to form a subbing layer, with the primer being prepared by dissolving or dispersing a polymer having carboxyl groups or groups which form carboxyl groups upon hydrolysis and an addition-polymerizable monomer selected from the group consisting of acrylic acid, itaconic acid, hexahydro-1,3,5-triacryl-s-triazine, N,N'-bisacryloyl piperazine, diacetone acrylamide and hexamethylene bis-ethyleneureide, whereby good adhesion between the polyester and a hydrophilic emulsion layer is obtained.

DETAILED DESCRIPTION OF PREFERRED EMBODIMENTS

According to the method of forming a subbing layer used in the present invention, it is not necessary at all to incorporate the above described etching agents in the primer. However, they can be added, if desired, to the primer. The polymer component in the primer composition comprises suitable polymers, copolymers or terpolymers which provide the desired adhesive strength. Further, it is possible to form a complete polymer component by using one or more copolymers.

As the polymers having carboxyl groups in the primer, those polymers having a molecular weight of about 5000 to 500,000 and preferably 100,000 to 400,000 are preferred. These polymers include, (1) homopolymers or copolymers of a polymerizable monomer having a carboxyl group or a group which easily forms a carboxyl group by hydrolysis (e.g., an ester group, a carboxylic acid salt group, a nitrile group, an acid chloride group, an acid anhydride group, an acid amide group, etc.). Specific examples of such monomers are acrylic acid, acryloxypropionic acid, methacrylic acid, ethacrylic acid, maleic acid, maleic acid anhydride, itaconic acid, itaconic acid anhydride, vinylbenzic acid, succinic acid or sorbic acid, with acrylic acid, methacrylic acid and maleic acid anhydride being preferred from the standpoint of handling, and (2) copolymers of these polymerizable monomers having a carboxyl group which easily forms a carboxyl group by hydrolysis with one or other copolymerizable monomers such as styrene and derivatives thereof such as methyl styrene, styrene sulfonic acid, chlorostyrene, etc.; esters of acrylic acid or methacrylic acid such as the methyl, ethyl, butyl, ethylhexyl and phenyl esters of acrylic acid and methacrylic, acid; hydroxyalkyl acrylates and methacrylates such as 2-hydroxyethylacrylate, 2-hydroxyethylmethacrylate, 2-hydroxy-propylacrylate, 2-hydroxypropylmethacrylate, 3-hydroxypropyl-acrylate, 3-hydroxypropylmethacrylate, 2-chloro-3-hydroxypropyl-acrylate and methacrylate, etc.; glycidyl acrylates and glycidyl-methacrylates such as glycidylacrylate, glycidylmethacrylate, glycidyletheracrylates and methacrylates; dimethylaminoethyl-methacrylate, t-butylaminoethylmethacrylate, etc.; amides such as acrylamide, methacrylamide, acryloyl morpholine, diacetone acryl-amide, N-methylolacrylamide, N-methylolmethacrylamide, etc.; acrylonitrile, chloroacrylonitrile, etc.; acrylacrylates and arylmethacrylates; aryloxyethylacrylate; aryloxyethylmethacrylate; diaryl itaconate; ethyleneglycoldimethacrylate; acrolein; vinyl esters such as vinyl acetate, vinyl propionate and vinyl benzoate; vinyl ethers such as methyl vinyl ether, butyl vinyl ether, chloroethyl vinyl ether, 2-aminoethylvinylether, and phenyl vinyl ether; crotonaldehyde, and vinylpyrrolidone, etc. Preferred copolymerizable monomers are styrene and its derivatives, vinyl acetate, and those containing a vinyl ether group. Further, hydrolyzed products of homo- or copolymers produced from esters or amides of $\alpha,\beta$-unsaturated carboxylic acids such as itaconic acid (e.g., diarylitaconate), acrylic acid or methacrylic acid as a starting monomer can be used. Moreover, copolymers of maleic acid anhydride can be used per se or as a hydrolyzed product thereof, a semi-amide thereof or a semi-ester thereof. These monomers are described in detail in U.S. Pat. Nos. 2,604,457, 2,798,861, 2,918,391 and 2,604,464 and in *Hannosei Kobunshi* (*Reactive High Molecular Substances*) published by Asakura Shoten.

Specific examples of polymers having carboxyl groups include copolymers of maleic anhydride and methyl vinyl ether having a molecular weight of about 100,000 to 400,000, copolymers of maleic anhydride and isobutyl vinyl ether having a molecular weight about 100,000 to 400,000, copolymers of maleic anhydride and vinyl acetate having a molecular weight of about 100,000 to 400,000, alumiunm polyacrylate having a molecular weight of about 10,000 to 300,000, acrylic acid-methyl acrylate-vinylidene chloride copolymers having a molecular weight of about 500,000 to 300,000, a copolymer of maleic anhydride and ethylvinylether, a copolymer of maleic anhydride and styrene, an itaconic acid-methylacrylate-vinylidene chloride copolymer, an acrylic acid-styrene-vinylpyrrolidone copolymer, etc.

Copolymers with other polymerizable monomers are particularly preferred from the standpoint of handling or solubility in solvents and stability.

In such a case, the ratio of the monomer having a carboxyl group or a material which forms the carboxyl group by hydrolysis is about 20 to 80% by mol or 30 to 75% by mol and preferably 50 to 75% by mol of the polymer. This ratio is chosen so as to provide a composition wherein (1) the properties thereof are not injured by an adhesion test in a wet condition and (2) the addition polymerizable monomer can be safely dispersed at room temperature (e.g., about 20° to 30° C.).

As the addition polymerizable monomers for use together with these polymers having carboxyl groups, there are (a) the so-called monofunctional monomers such as acrylic acid, itaconic acid and diacetone acrylamide and (b) polyfunctional monomers such as hexahydro-1,3,5-triacryl-s-triazine, N,N'-bisacryloyl piperazine, and hexamethylene bis-ethyleneureide.

These monomers are chosen so as to be stably dispersed in the polymer having carboxyl groups or groups which form carboxyl groups upon hydrolysis. It is important that the monomer be added in an amount so that the viscosity does not rapidly increase with the lapse of time, if desired, during a cooling treatment. Thus, an amount of about 0.1 to 100% by weight and preferably 2.5 to 60% by weight based on the polymer having carboxyl groups or groups which form carboxyl groups upon hydrolysis is suitable. If desired, a thermal polymerization inhibitor such as an aromatic ketone or an aromatic quinone can be added in the amount of about 0.0001 to 5% based on the addition-polymerizable monomer. Suitable examples of thermal polymerization inhibitors are diphenylpicrylhydrazyl, tri-p-nitrophenylmethyl-N-(3-N-oxyanilino-1,3-dimethylbutylidene) aniline oxide, p-benzoquinone, p-tert-butyl-catechol, nitrosobenzene, picric acid, dithiobenzoyldisulfide, copper (II) chloride, etc. A suetable solvent which can be used for the primer containing these polymers and addition polymerizable monomers is water. Although organic solvents are not necessary in some cases, they can be used, if desired.

In using an organic solvent, alcohol type solvents such as methanol, ethanol, methyxyethanol, acetoxyethanol and ethoxyethanol, ketone type solvents such as methylethylketone, acetone and acetophenone, ether type solvents such as tetrahydrofuran, dioxane and dimethoxyethane, polar solvents such as dimethylformamide, methylpyrrolidone, dimethylacetamide and dimethylsulfoxide, and mixtures of these solvents and water are used. These solvents are used in the amount that the above described polymers and addition polymerizable monomers dissolve therein either alone or in combination in an amount of about 0.01 to 10% by weight.

In addition, a reinforcing agent for the subbing layer (such as resorcinol, cresol, p-chlorophenol, benzoic acid, etc., an adhesion improving agent such as epichlorohydrin, 2,2'-bis(p-glycidyloxy)benzene, 1,3-bis(2',3'-epoxy propoxy)ethane, mucochloric acid, glyceraldehyde, proparglyacetal, etc.), an antistatic agent (such as LiCl, KCl, $CaCl_2$, $BaCl_2$, polyvinylbenzyltrialkylammoniumchloride, (N,N-dimethyl-3,5-methylenepiperidiniumchloride), polyoxyethylene sorbitan monolaurate, sodium stearate, sodium di-2-ethylhexylsulfosuccinate, etc.) and a matting agent may be added to the primer. Further, in order to prevent a reduction in the limiting viscosity by the surface treatment of the polyester so as to enable repeated use, a cross-linking agent having a carboxyl group, a methylol group, a hydroxyl group, an oxirane group, an epoxy group, an isocyanate group, an acetal group, a vinyl group, an oxy group, a carbo-diimide group or a phenolic hydroxyl group, etc. or a metal cross-linking agent can be added thereto.

Though the amount of the primer applied to the polyester film is not limited, preferably about 1 to 10 g per $m^2$, and particularly 2 to 5 g per $m^2$, is used.

As the polyesters used in the present invention, those polyesters of an aromatic dicarboxylic acid and an aliphatic diol as main ingredients and those produced from an aromatic monocarboxylic acid having an aliphatic hydroxyl group as a starting material can be used. Of these polyesters, polyesters prepared from an aromatic dicarboxylic acid such as terephthalic acid, naphthalene dicarboxylic acid or isophthalic acid and ethylene glycol, 1,4-butanediol or propanediol are suitably used. Particularly, polyethylene terephthalate is preferred because it is easily available. Accordingly, examples using polyethylene terephthalate are illustrated in the following.

The present invention provides a method of treating a surface of polyester film. Although the thickness of the polyester film used is not limited, a linear polyester film which is biaxially stretched and crystallized is preferred, because dimensional stability is required for the support of photographic materials. As described hereinbefore the polyester surface is treated to render it hydrophilic. Any of the prior art methods can be used and of these a flame treatment to render the surface hydrophilic is the most effective in this invention and is preferred.

As photographic emulsions for applying, emulsions containing a hydrophilic binder, for example, gelatin are used. The emulsions are not limited with respect to materials which can be included or dispersed therein and suitable examples of emulsions are those such as a color negative-, color positive-, black-white- or diffusion transfer emulsion.

In general, the method of the present invention is carried out as follows. After a surface treatment of a linear polyester film support which has been biaxally oriented and crystallized by stretching has been conducted, a primer prepared by dispersing or dissolving a carboxyl group containing polymer and an addition polymerizable monomer is applied to the treated surface. It is then treated with a sqeezing roll or an air knife so that the desired amount is applied, and dried in a drying area. Then the film is rolled up. An emulsion layer is then applied to the resulting subbing layer. Evaluation of the test of adhesion between the support and the emulsion layer of the photographic film carried out in the following examples was as follows.

(1) Adhesion test in a dry condition.

On the emulsion surface of a raw film and that of the treated dry film, linear scratches were made using razor to form an about 4 mm mesh pattern. After a pressure sensitive adhesive tape (e.g., Scotch Tape, 3 M) was adhered to the scratched surface, it was peeled off instantly. The evaluation was Grade A where the peeled area was 0 to 5%, Grade B where the peeled area was 5 to 30% and Grade C where the peeled area was 30 to 100%.

(2) Adhesion test in a wet condition during processing.

Two scratches in the form of a cross were made on the emulsion surface of the film in treating solutions at each of development, fixing or rinsing using a steel pen. Then the surface was rubbed in a perpendicular direction to the scratch line with a finger tip. The evaluation was Grade A where the emulsion layer did not peel, Grade B where the maximum peeling was within 5 mm, and Grade C where the maximum peeling was about 5 mm.

The present invention is illustrated in greater detail by reference to the following examples.

EXAMPLE 1

Simultaneously, both surfaces of a polyethylene terephthalate film support having a width of 30 cm and a thickness of 200μ were subjected to a flame treatment. The polyethylene terephthalate film support was treated at a speed of 100 m/min. by applying vertically a flame of the following combustion gas composition 1 at a distance of 3 cm. Then Primer Composition 1 was applied thereto at a completely separate application zone and dried at 140° C. for 5 minutes. The area of the flame opening was 30 cm × 0.5 mm or so. The primer was used in an amount of about 80 ml per $m^2$ of the polyester.

| Combustion Gas Composition 1: | |
|---|---|
| Propane | 0.9 kg/hour |
| Oxygen | 2.1 kg/hour |

| Primer Composition 1 | parts by weight |
|---|---|
| Maleic Acid Anhydride-Methyl Vinyl Ether (1:1 molar ratio) Copolymer (molecular weight: about 300,000) | 4 |
| Hexahydro-1,3,5-triacryl-s-triazine | 2 |
| Distilled Water | 95 |

To the polyethylene terephthalate film support provided with a subbing layer, a gelatin-silver halide emulsion was applied and dried to produce a photographic sensitive film. The adhesive strength of this film in the dry condition was A. Further, the photographic properties of the resulting photographic sensitive film were excellent.

EXAMPLE 2

A polyethylene terephthalate film (200μ) was used and flame treatment was carried out using combustion gas composition 2 at a treating rate of 500 m/min. Then Primer Composition 1 as described in Example 1 was applied in the same amount as in Example 1 and dried at 150° C. for 2 minutes. Then the same procedure was carried out as in Example 1.

| Combustion Gas Composition 2 | |
|---|---|
| Methane | 0.7 kg/hour |
| Oxygen | 4.2 kg/hour |

The adhesive strength of the resulting photographic sensitive film in the dry condition and that in the wet condition during processing were both Grade A, and the photographic properties thereof were excellent.

EXAMPLE 3

Both surfaces of a polyethylene terephthalate film support having a width of 30 cm and thickness of 100μ were subjected to a corona discharging treatment in turn under the following conditions. The treatment was carried out at a rate of 100 m/min. Then Primer Composition 2 was applied thereto. The primer was used in the amount of 40 g per $m^2$ of the polyester.

| Conditions of Corona Discharging Treatment: | |
|---|---|
| Interval | 1 mm |
| Discharge output | 600 W |

| Primer Composition 2 | parts by weight |
|---|---|
| Maleic Acid Anhydride-Methyl Vinyl Ether (1:1 molar ratio) Copolymer | 2.5 |
| Hexahydro-1,3,5-triacryl-s-triazine | 1.25 |
| Distilled Water | 97.5 |

Primer Composition 2 cooled to about 15° C. had very good stability after the lapse of time. After 30 days had elapsed, a rapid increase in the viscosity was not observed. The adhesive strength of the resulting photographic sensitive film in the dry condition and that in the wet condition during processing were both Grade A, and the photographic properties thereof were excellent as well.

EXAMPLE 4

Both surfaces of a polyethylene terephthalate film support having a width of 30 cm and a thickness of 200μ were exposed to light from 16 quarty mercury lamps of 3 KW having a tube length of 45 cm and an effective arc length of about 30 cm at a distance of 10 cm by passing at a rate of 40 m/min. while keeping the temperature at 120° C. Then Primer Composition 1 was applied thereto and dried at 120° C. for 10 minutes. The adhesive strength of the resulting photographic sensitive film in the dry condition and that in the wet condition during processing were both Grade A, and the photographic properties thereof were excellent as well.

EXAMPLE 5

The surface treatment was carried out under the same conditions as in Example 1. Then, Primer Composition 3 was applied thereto and dried at 150° C. for 2 minutes. The primer was used in an amount of about 80 g per $m^2$ of the polyester.

| Primer Composition 3: | parts by weight |
|---|---|
| Maleic Acid Anhydride-Methyl Vinyl Ether (1:1 molar ratio) Copolymer | 4.0 |
| N,N-bis-Acryloyl Piperazine | 2.0 |
| Distilled Water | 95.0 |

The adhesive strength of the resulting photographic sensitive film in the dry condition and that in the wet condition during processing were both Grade A, and the photographic properties thereof were excellent too.

EXAMPLE 6

A surface treatment was carried out under the same conditions as in Example 1. Then Primer Composition 4, the pH of which was adjusted to 5 by adding an aqueous ammonia solution to the mother solution, was applied thereto and dried at 150° C. for 2 minutes.

| Primer Composition 4: | parts by weight |
|---|---|
| Maleic Acid Anhydride-Methyl Vinyl Ether (1:1 molar ratio) Copolymer | 2.5 |
| N,N'-bis-Acryloyl-piperazine | 1.0 |
| Distilled Water | 97.0 |

The adhesive strength of the resulting photographic sensitive film in the dry condition and that in the wet condition during processing were both Grade A, and the photographic properties thereof were excellent too.

EXAMPLE 7

A surface treatment was carried out under the same conditions as in Example 1. Then Primer Composition 5 was applied thereto and dried at 150° C. for 2 minutes.

| Primer Composition 5: | parts by weight |
|---|---|
| Maleic Acid Anhydride-Methyl Vinyl Ether (1:1 molar ratio) Copolymer | 5.0 |
| Itaconic Acid | 4.5 |
| Distilled Water | 95.0 |

The adhesive strength of the resulting photographic sensitive film in the dry condition and that in the wet condition during processing were both Grade A, and the photographic properties thereof were excellent too.

EXAMPLE 8

A surface treatment was carried out under the same conditions as in Example 1. Then Primer Composition 6 was applied thereto and dried at 150° C. for 2 minutes.

| Primer Composition 6: | parts by weight |
|---|---|
| Maleic Acid Anhydride-Ethyl Vinyl Ether (1:1 molar ratio) Copolymer | 4.0 |
| Hexahydro-1,3,5-triacryl-s-triazine | 2.0 |
| Distilled Water | 95.0 |

The adhesive strength of the resulting photographic sensitive film in the dry condition and that in the wet condition during processing were both Grade A, and the photographic properties thereof were excellent too.

EXAMPLE 9

A surface treatment was carried out under the same conditions as in Example 1. Then, Primer Composition 7 was applied thereto and dried at 150° C. for 2 minutes.

| Primer Composition 7: | parts by weight |
|---|---|
| Maleic Acid Anhydride-iso-Butyl Vinyl Ether (1:1 molar ratio) Copolymer | 4.0 |
| Hexahydro-1,3,5-triacryl-s-triazine | 2.0 |
| Distilled Water | 95.0 |

The adhesive strength of the resulting photographic sensitive film in the dry condition and that in the wet condition during processing were both Grade A, and the photographic properties thereof were excellent too.

EXAMPLE 10

A surface treatment was carried out under the same conditions as in Example 1. Then, the following Primer Composition 8 was applied thereto and dried at 150° C. for 2 minutes.

| Primer Composition 8: | parts by weight |
|---|---|
| Maleic Acid Anhydride-Styrene (1:1 molar ratio) Copolymer (mol. wt. about 400,000) | 4.0 |
| Hexahydro-1,3,5-triacryl-s-triazine | 2.0 |
| Methanol | 80.0 |
| Distilled Water | 20.0 |

The adhesive strength of the resulting photographic sensitive film in the dry condition and that in the wet condition during processing were both Grade A, and the photographic properties thereof were excellent too.

EXAMPLE 11

A surface treatment was carried out under the same conditions as in Example 1. Then, Primer Composition 9 was applied thereto and dried at 150° C. for 2 minutes.

| Primer Composition 9: | parts by weight |
|---|---|
| Maleic Acid Anhydride-Vinyl Acetate (1:1 molar ratio) Copolymer | 5.0 |
| Hexahydro-1,3,5-triacryl-s-triazine | 2.5 |
| Distilled Water | 95.0 |

The adhesive strength of the resulting photographic sensitive film in the dry condition and that in the wet condition during processing were both Grade A, and the photographic properties thereof were excellent as well.

EXAMPLE 12

A surface treatment was carried out under the same conditions as in Example 1. Then, Primer Composition 10 was applied thereto and dried at 150° C. for 2 minutes.

| Primer Composition 10: | parts by weight |
|---|---|
| Aluminium Polyacrylate | 3.0 |
| Gelatin | 0.3 |
| Hexahydro-1,3,5-triacryl-s-triazine | 1.5 |
| Distilled Water | 95.5 |

The adhesive strength of the resulting photographic sensitive film in the dry condition and that in the wet condition during processing were both Grade A, and the photographic properties thereof were excellent too.

EXAMPLE 13

A surface treatment of a PET film support having a width of 30 cm and a thickness of 100μ was carried out under the same condition as in Example 1. Then, Primer Composition 11 was applied thereto and dried at 150° C. for 2 minutes.

| Primer Composition 11: | parts by weight |
|---|---|
| Acrylic Acid-Methyl Acrylate-Vinylidene Chloride (6:35:59 molar ratio) Copolymer | 4.0 |
| Hexahydro-1,3,5-triacryl-s-triazine | 2.5 |
| Distilled Water | 94.0 |

The adhesive strength of the resulting photographic sensitive film in the dry condition and that in the wet condition during processing were both Grade A, and the photographic properties thereof were excellent too.

EXAMPLE 14

A surface treatment was carried out under the same conditions as in Example 13. Then, Primer Composition 12 was applied, thereto and dried at 150° C. for 2 minutes.

| Primer Composition 12: | parts by weight |
|---|---|
| Itaconic Acid-Methyl Acrylate-Vinylidene Chloride (2:39:59 molar ratio) Copolymer | 4.0 |
| Hexahydro-1,3,5-triacryl-s-triazine | 2.5 |
| Distilled Water | 94.0 |

The adhesive strength of the resulting photographic sensitive film in the dry condition and that in the wet condition during processing were both Grade A, and the photographic properties thereof were excellent too.

EXAMPLE 15

A surface treatment was carried out under the same conditions as in Example 1. Then, Primer Composition 13 was applied thereto and dried at 150° C. for 2 minutes.

| Primer Composition 13: | parts by weight |
|---|---|
| Acrylic Acid-Styrene-Vinyl Pyrrolidone (30:2:68 molar ratio) Copolymer | 5.0 |
| Hexahydro-1,3,5-triacryl-s-triazine | 2.5 |
| Distilled Water | 93.0 |

The adhesive strength of the resulting photographic sensitive film in the dry condition and that in the wet condition during processing were both Grade A, and the photographic properties thereof were excellent too.

EXAMPLE 16

A surface treatment was carried out under the same conditions as in Example 1. Then Primer Composition 14 was applied thereto and dried at 150° C. for 2 minutes.

| Primer Composition 14 | Parts by weight |
|---|---|
| Maleic Acid Anhydride-Methyl Vinyl Ether (1:1 molar ratio) Copolymer | 5.0 |
| Acrylic Acid | 4.5 |
| Distilled Water | 95.0 |

The adhesive strength of the resulting photographic sensitive film in the dry condition and that in the wet condition during processing were both Grade A, and the photographic properties thereof were excellent too.

EXAMPLE 17

Example 16 was repeated except that acrylic acid was replaced by diacetone acrylamide in the same amount.

The adhesive strength of the resulting photographic sensitive film in the dry condition was Grade A and that in the wet condition during processing was Grade B. The photographic properties thereof were excellent too.

EXAMPLE 18

A surface treatment was carried out under the same conditions as in Example 1. Then Primer Composition 15 was applied thereto and dried at 150° C. for 2 minutes.

| Primer Composition 15 | Parts by weight |
|---|---|
| Maleic Acid Anhydride-Methyl Vinyl Ether (1:1 molar ratio) Copolymer | 5.0 |
| Hexamethylene bis-ethyleneureide | 4.5 |
| Distilled Water | 95.0 |

The adhesive strength of the resulting photographic sensitive film in the dry condition and that in the wet condition during processing were both Grade A, and the photographic properties thereof were excellent too.

COMPARATIVE EXPERIMENTS

A surface treatment was carried out under the same condition as in Example 1. Then Primer Compositions 16–18 were each applied thereto and dried at 150° C. for 2 minutes.

| Primer Composition 16 | Parts by weight |
|---|---|
| Maleic Acid Anhydride-Methyl Vinyl Ether (1:1 molar ratio) Copolymer | 5.0 |
| Methyl Methacrylate | 4.5 |
| Distilled Water | 95.0 |

| Primer Composition 17 | Parts by weight |
|---|---|
| Maleic Acid Anhydride-Methyl Vinyl Ether (1:1 molar ratio) Copolymer | 5.0 |
| n-Butyl Methacrylate | 4.5 |
| Distilled Water | 95.0 |

| Primer Composition 18 | Parts by weight |
|---|---|
| Maleic Acid Anhydride-Methyl Vinyl Ether (1:1 molar ratio) Copolymer | 5.0 |
| Maleic Acid | 4.5 |
| Distilled Water | 95.0 |

When Primer Composition 16 was used, the adhesive strength of the resulting photographic sensitive film in the dry condition and that in the wet condition during processing were both Grade B.

When Primer Composition 17 was used, the adhesive strength in the dry condition was Grade C, and that in the wet condition was Grade B.

When Primer Composition 18 was used, the adhesive strength in the dry condition was Grade B, and that in the wet condition was Grade C.

While the invention has been described in detail and with reference to specific embodiments thereof, it will be apparent to one skilled in the art that various changes and modifications can be made therein without departing from the spirit and scope thereof.

What is claimed is:

1. A light-sensitive element comprising a polyester support, a surface of which has been subjected to a treatment to render the surface hydrophilic; a subbing layer on the treated surface comprising a polymer having carboxyl groups or groups which form carboxyl groups upon hydrolysis, said polymer having a molecular weight of about 5,000 to 500,000 and as an addition polymerizable monomer, hexahydro-1,3,5-triacryl-s-triazine, said addition polymerizable monomer being present in an amount of about 2.5 to 100% by weight based on said polymer having carboxyl groups or groups which form carboxyl groups upon hydrolysis; and a silver halide emulsion layer on said subbing layer.

2. The light-sensitive element of claim 1, wherein said polymer having carboxyl groups or groups which form carboxyl groups upon hydrolysis comprises (1) homopolymers or copolymers of a polymerizable monomer having a carboxyl group or a group which forms a carboxyl group by hydrolysis, or (2) copolymers of a polymerizable monomer having a carboxyl group or a group which forms a carboxyl group by hydrolysis with at least one of a copolymerizable monomer not containing a carboxyl group or a group which forms a carboxyl group by hydrolysis.

3. The light-sensitive element of claim 2, wherein said polymerizable monomer having a carboxyl group or a group which forms carboxyl group by hydrolysis is acrylic acid, acryloxypropionic acid, methacrylic acid, ethacrylic acid, maleic acid, maleic acid anhydride, itaconic acid, itaconic acid anhydride, vinylbenzoic acid, succinic acid, or sorbic acid.

4. The light-sensitive element as claimed in claim 3, wherein said polymerizable monomer having a carboxyl group or a group which forms a carboxyl group by hydrolysis is acrylic acid, methacrylic acid, or maleic acid anhydride.

5. The light-sensitive element as claimed in claim 1, wherein said polymer having carboxyl groups or groups which form carboxyl groups upon hydrolysis is a copolymer of maleic anhydride and methylvinylether, a copolymer of maleic anhydride and isobutylvinylether, a copolymer of maleic anhydride and vinyl acetate, a copolymer of maleic anhydride and ethylvinylether, a copolymer of maleic anhydride and styrene, an itaconic acid-methylacrylate-vinylidene chloride copolymer, an acrylic acid-styrene-vinylpyrrolidone copolymer, aluminum polyacrylate, or an acrylic acid-methylacrylate-vinylidene chloride copolymer.

6. The light-sensitive element as claimed in claim 1, wherein said polymer having carboxyl groups or groups which form carboxyl groups contains monomer units having carboxyl groups or groups which form carboxyl groups upon hydrolysis in an amount of 20 to 75% on a molar basis.

7. The light-sensitive element of claim 1, wherein said subbing layer is present in an amount of about 1 to 10 g/square meter.

8. The light-sensitive element of claim 1, wherein said polyester support is a support of a linear polyester which is biaxially stretched and crystallized.

9. The light-sensitive element of claim 8, wherein said polyester comprises the polycondensation product of an aromatic dicarboxylic acid and an aliphatic diol or an aromatic monocarboxylic acid containing an aliphatic hydroxyl group.

10. The light-sensitive element of claim 9, wherein said aromatic dicarboxylic acid is terephthalic acid, naphthalene dicarboxylic acid, or isophthalic acid and said aliphatic diol is ethylene glycol, 1,4-butanediol or propanediol.

11. The light-sensitive element of claim 8, wherein said polyester is polyethylene terephthalate.

12. The light-sensitive element of claim 1, wherein said treatment to render the surface hydrophilic is a flame treatment.

13. The light-sensitive element of claim 1, wherein said subbing layer consists essentially of said polymer having carboxyl groups or groups which form carboxyl groups upon hydrolysis and said addition polymerizable monomer.

14. The light-sensitive element of claim 1, wherein said addition polymerizable monomer is present in an amount of 2.5 to 60% by weight based on said polymer having carboxyl groups or groups which form carboxyl groups upon hydrolysis.

* * * * *